US009632458B2

(12) United States Patent
Nakamura et al.

(10) Patent No.: US 9,632,458 B2
(45) Date of Patent: Apr. 25, 2017

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Fumiaki Nakamura, Joso (JP); Takahiro Miyakawa, Dairen (CN)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/874,603

(22) Filed: Oct. 5, 2015

(65) Prior Publication Data

US 2016/0097992 A1 Apr. 7, 2016

(30) Foreign Application Priority Data

Oct. 7, 2014 (JP) ..... 2014-206278

(51) Int. Cl.
*G03G 15/08* (2006.01)

(52) U.S. Cl.
CPC ..... *G03G 15/0891* (2013.01)

(58) Field of Classification Search
CPC ..... G03G 15/0889; G03G 15/0891
See application file for complete search history.

(56) References Cited

U.S. PATENT DOCUMENTS 7,251,440 B2 * 7/2007 Shigeta ..... G03G 15/0877 399/254
8,452,215 B2 * 5/2013 Mihara ..... G03G 15/08 399/254

FOREIGN PATENT DOCUMENTS

JP 2006-99044 A 4/2006

* cited by examiner

*Primary Examiner* — Clayton E LaBalle
*Assistant Examiner* — Victor Verbitsky
(74) *Attorney, Agent, or Firm* — Canon U.S.A., Inc., IP Division

(57) ABSTRACT

A developing device includes a developer agitation portion including a plurality of trap agitation blades arranged in an axis direction of the developer agitation portion. A plurality of agitation blade portions is arranged with being shifted from one another in a circumferential direction and a longitudinal direction of the developer agitation portion. Two adjacent trap agitation blades constituting the agitation blade portion are arranged at an angle so as to make a space between the two adjacent trap agitation blades gradually wider upstream with respect to a rotation direction of the developer agitation portion.

17 Claims, 11 Drawing Sheets

DEVELOPING DEVICE, PROCESS CARTRIDGE, AND IMAGE FORMING APPARATUS

BACKGROUND OF THE INVENTION

Field of the Invention

The present invention relates to a developing device used in an electrophotographic image forming apparatus that forms an image on a recording medium through an electrophotographic image forming method, and a process cartridge and an image forming apparatus that include the developing device.

Description of the Related Art

Conventionally, the following developing device has been widely used in an image forming apparatus. More specifically, a developing roller bears developer on its circumferential surface and rotates to supply the developer to an electrophotographic photosensitive member arranged to face the developing roller, so that an electrostatic latent image formed on the electrophotographic photosensitive member is developed.

Further, a developer agitation member for agitating the developer stored in a developer container is used in the developing device. As illustrated in FIG. 11, there has been known a developer agitation member 23 that includes a plurality of rotational agitation portions 23*a*1 to 23*d*1 having different rotation radii and being supported by respective supporting portions 23*a*2 to 23*d*2 of a shaft portion 23*e* serving as a rotation center of the entirety (Japanese Patent Application Laid-Open No. 2006-99044).

The developer agitation member 23 is configured in such a manner that distances from the shaft portion 23*e* serving as a rotation center of the entirety to the supporting portions 23*a*2 and 23*c*2 respectively supporting the rotational agitation portions 23*a*1 and 23*c*1 are set longer than distances from the shaft portion 23*e* to the supporting portions 23*b*2 and 23*d*2 respectively supporting the rotational agitation portions 23*b*1 and 23*d*1. With this configuration, loci of the rotational agitation portions 23*a*1 and 23*c*1 rotating about the shaft portion 23*e* are set to be larger than loci of the rotational agitation portions 23*b*1 and 23*d*1 rotating about the shaft portion 23*e*. Further, coil-shaped movable agitation portions 23*a*4 to 23*d*4 having the inner diameters larger than the outer diameters of the rotational agitation portions 23*a*1 to 23*d*1 are movably attached to the outer circumferences of the respective rotational agitation portions 23*a*1 to 23*d*1.

Then, when the developer agitation member 23 is rotated, developer within a developer container 24 can be scooped up and agitated, so that the developer within the developer container 24 and the developer newly supplied to the developer container 24 can be sufficiently agitated and then supplied to a developing roller.

However, the above-described conventional technique has limitations in terms of design because the configuration thereof requires a large number of components. Therefore, although there is a demand for a miniaturized and low-cost image forming apparatus, it is difficult to satisfy such a demand for lower cost.

SUMMARY OF THE INVENTION

The present invention is directed to a low-cost developing device.

According to an aspect of the present invention, a developing device includes a developer storage portion configured to store developer, and a developer agitation portion configured to rotate in the developer storage portion to agitate developer. The developer agitation portion includes a plurality of trap agitation blades arranged in an axis direction of the developer agitation portion, and each of the trap agitation blades is disposed in a direction intersecting with the axis direction of the developer agitation portion. A plurality of agitation blade portions, each including a set of two trap agitation blades adjacent in the axis direction of the developer agitation portion, is arranged with being shifted from one another in a circumferential direction and a longitudinal direction of the developer agitation portion. The two adjacent trap agitation blades constituting the agitation blade portion are arranged at an angle so as to make a space between the two adjacent trap agitation blades gradually wider upstream with respect to a rotation direction of the developer agitation portion.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the attached drawings. As long as a developer agitation shaft 6 for agitating developer is arranged along a developer bearing member, the present invention can be implemented by another exemplary embodiment in which all or part of the configuration of the exemplary embodiments is replaced with an alternative configuration.

Accordingly, the present invention can be implemented by any image forming apparatuses that execute image formation using developer regardless of a tandem type or a single drum type, an intermediate transfer type, a recording material conveyance type, or a direct transfer type, and a black-and-white type or a full-color type. In the present exemplary embodiment, description will be given of main portions relating to formation and transfer of a toner image. However, the present invention can be implemented in various ways such as printers, various printing apparatuses, copying machines, facsimiles, and multifunction peripherals by adding necessary devices, units, and housing structures.

<Image Forming Apparatus>

Figure 1:
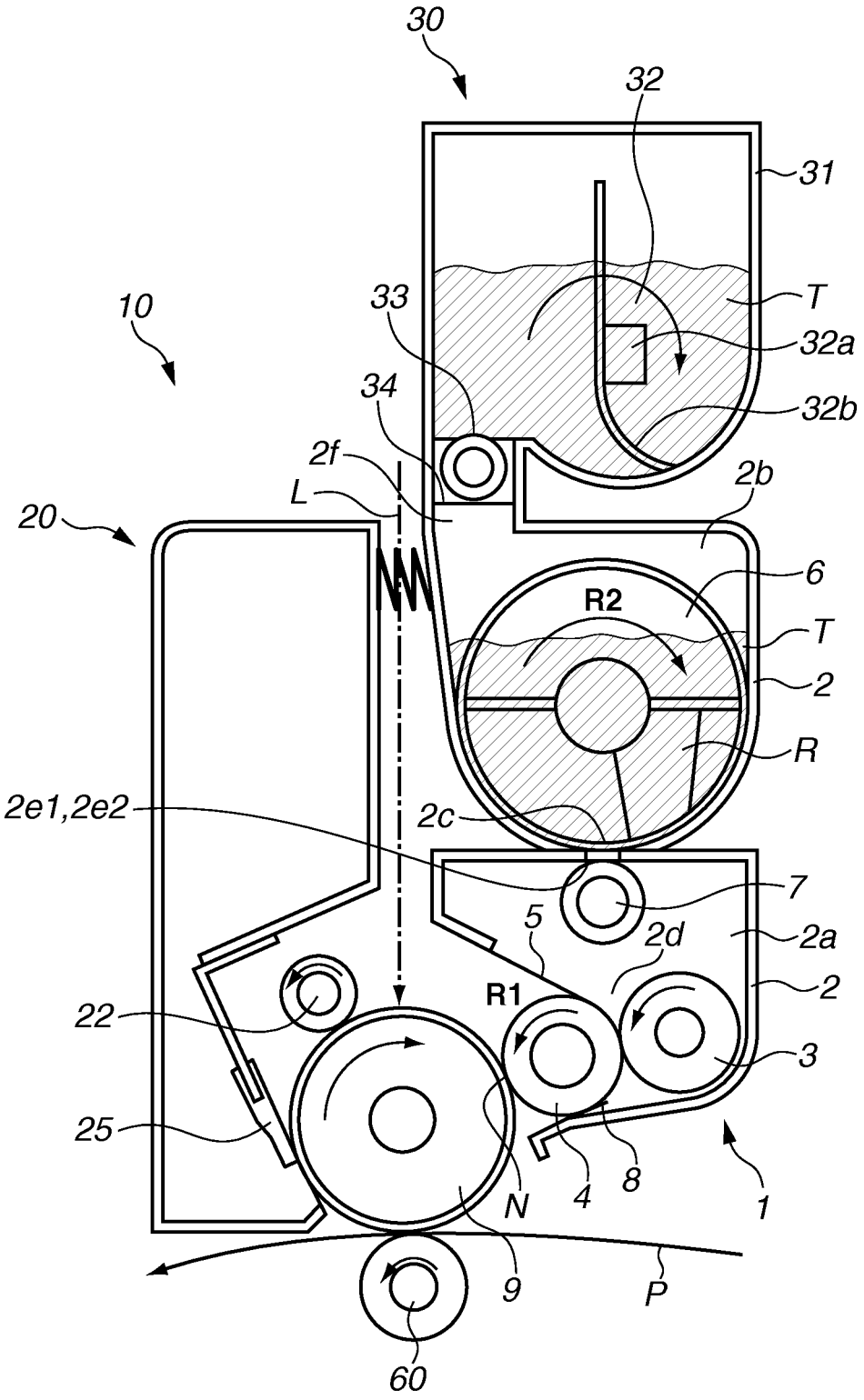
FIG. 1 is a cross-sectional view illustrating main portions of an image forming apparatus to which a process cartridge including a developing device and a developer supply device for supplying developer to the developing device are detachably attached.
Figure 2:
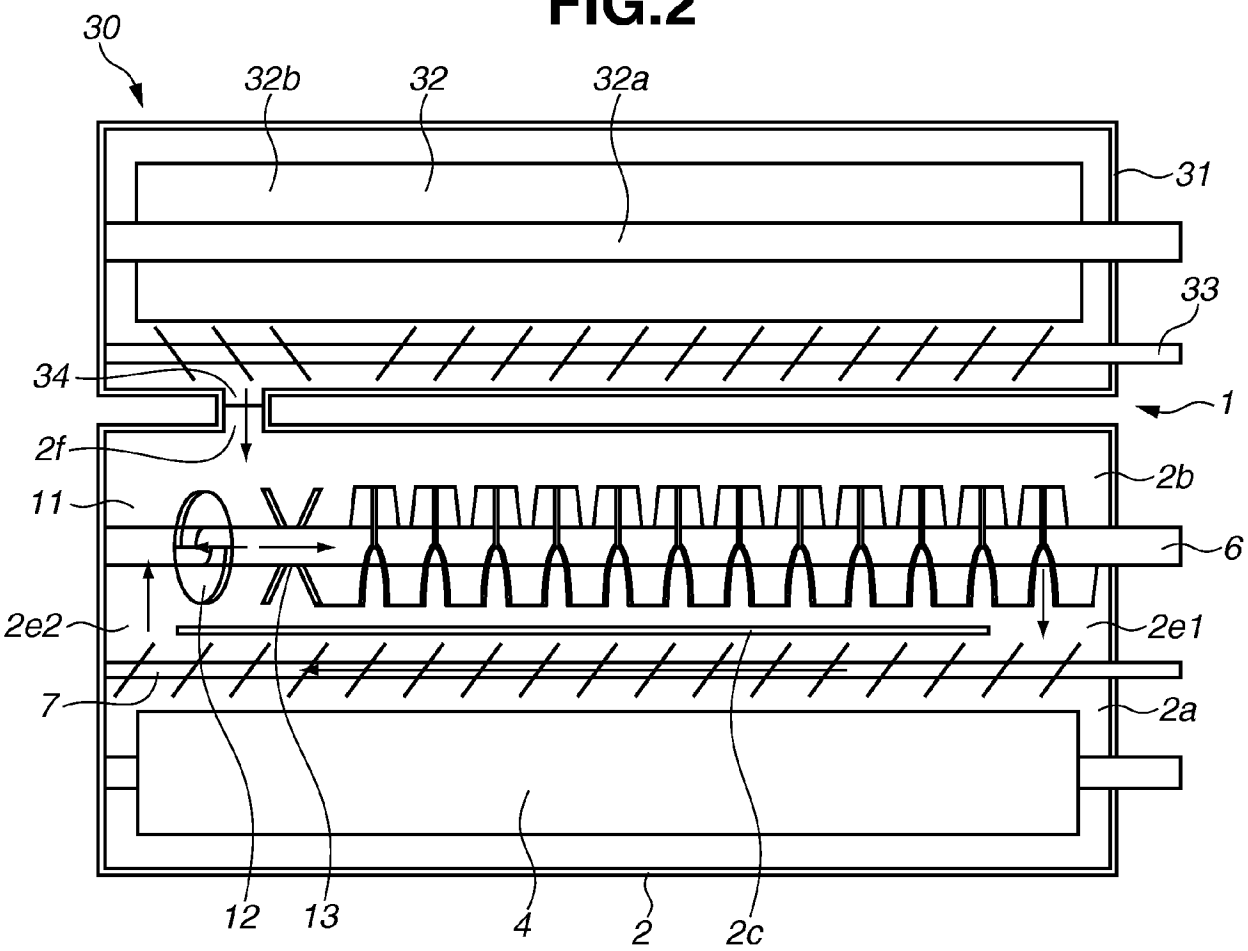
FIG. 2 is a longitudinal cross-sectional view schematically illustrating a developing device and a developer supply device.

FIG. 1 is a cross-sectional view illustrating main portions of an electrophotographic image forming apparatus in which a process cartridge 10 including a developing device according to the present exemplary embodiment and a developer supply device 30 for supplying developer to the developing device are employed. The process cartridge 10 has a frame structure in which a developing device 1 and a cleaning device 20 are integrally formed, and is detachably attached to a main unit of the electrophotographic image forming apparatus. FIG. 2 is a longitudinal cross-sectional view of the developing device 1 and the developer supply device 30 that are illustrated in FIG. 1, as seen from the left direction in FIG. 1.

The image forming apparatus will be described with reference to FIGS. 1 and 2. A rotary drum type electrophotographic photosensitive member (hereinafter, simply referred to as "photosensitive drum") 9 serves as an image bearing member. The photosensitive drum 9 is rotated by a driving mechanism (not illustrated) in a clockwise direction indicated by an arrow in FIG. 1 at a predetermined speed. A charging roller 22 serving as a charging unit is brought into contact with the photosensitive drum 9. A predetermined charging bias is applied to the charging roller 22, so that the outer circumferential surface of the photosensitive drum 9 is uniformly charged to a predetermined polarity and potential. With respect to the charged photosensitive drum 9, an image exposure unit (not illustrated) performs image exposure L according to image information. Through this operation, an electrostatic latent image corresponding to an image exposure pattern is formed on the photosensitive drum 9. The developing device 1 develops the electrostatic latent image using developer.

Meanwhile, a sheet feeding mechanism (not illustrated) feeds a recording medium P (e.g., plain paper or special sheet) to a transfer portion serving as a nip portion between the photosensitive drum 9 and a transfer roller 60 serving as a transfer unit, at a predetermined timing. The recording medium P is nipped and conveyed at the transfer portion. During this period, a predetermined transfer bias is applied to the transfer roller 60. As a result, a developer image formed on the photosensitive drum 9 is sequentially transferred onto the recording medium P. The recording medium P that has passed through the transfer portion is separated from the photosensitive drum 9 and conveyed to a fixing device (not illustrated). The developer image is fixed onto the recording medium P by the fixing device. The cleaning device 20 removes residual developer from the photosensitive drum 9 with a cleaning blade 25 after the recording medium P is separated from the photosensitive drum 9.

In the developing device 1 according to the present exemplary embodiment, a developing roller 4 serving as a developer bearing member is brought into contact with the photosensitive drum 9. The developing device 1 employs a contact development system in which development is executed with developer T being in contact with the circumferential surface of the photosensitive drum 9.

The developing device 1 includes the developing roller 4, a supply roller 3 serving as a developer supply unit, a blade 5 serving as a developer regulation unit, and the developer agitation shaft 6 serving as a developer agitation portion. The developing roller 4 bears the developer T on its circumferential surface to convey the developer T. As a result, the developing roller 4 brings the developer T into contact with the photosensitive drum 9 to develop the electrostatic latent image. The supply roller 3 supplies the developer T to the developing roller 4. The blade 5 regulates the amount of developer T adhering to the circumferential surface of the developing roller 4. With this configuration, the blade 5 forms a thin layer of developer T on the circumferential surface of the developing roller 4. The developer agitation shaft 6 rotates in order to agitate the developer T supplied from the developer supply device 30 and the developer T existing in the developing device 1.

The developing device 1 stores the developer T in a developer container 2. The developer container 2 includes a development chamber 2*a*, an agitation chamber 2*b* serving as a developer storage portion, and a partition wall 2*c*. The developing roller 4, the supply roller 3, and the blade 5 are arranged in the development chamber 2*a*. The agitation chamber 2*b* stores the developer T used for the development of the electrostatic latent image. Then, the developer agitation shaft 6 is arranged in the developer container 2 (agitation chamber 2*b*).

The partition wall 2*c* is provided in order to move the developer T from the agitation chamber 2*b* to the development chamber 2*a*. Accordingly, the developer T stored in the agitation chamber 2*b* passes through the partition wall 2*c* so as to be conveyed to the development chamber 2*a*. The development chamber 2*a* and the agitation chamber 2*b* communicate with each other only through a downstream opening 2*e*1 and an upstream opening 2*e*2 provided only on both end portions thereof.

A screw 7 serving as a longitudinal conveyance member is arranged in the development chamber 2*a*. The screw 7 conveys the developer T within the development chamber 2*a* in a longitudinal direction, and conveys the developer T that falls from the downstream opening 2*e*1 toward the longitudinal center direction in the development chamber 2*a*. Further, the screw 7 conveys the developer T within the development chamber 2*a* to the upstream opening 2*e*2 to convey the developer T to the agitation chamber 2*b* again.

Further, the screw 7 and the developer agitation shaft 6 are connected to the developing roller 4 and the supply roller 3 with a gear (not illustrated). With this configuration, during image formation, i.e., while the developing roller 4 is rotating, the screw 7 and the developer agitation shaft 6 rotate together. Then, the screw 7 and the developer agitation shaft 6 stop rotating when the image formation is completed.

The developer container 2 further includes a developer opening 2*d* at a part on the opposite side of the photosensitive drum 9. A part of the developing roller 4 is exposed from the developer opening 2*d*. Further, the developing roller 4 is supported by the developer container 2 so as to be rotatable in a direction indicated by an arrow R1. The developing roller 4 has an elastic member on its circumferential surface, and makes contact with the photosensitive drum 9 at a predetermined contact pressure. Further, the developer opening 2*d* is provided with a scattering prevention sheet 8 along a longitudinal direction. The scattering prevention sheet 8 prevents the developer T from scattering from the lower portion of the developing roller 4.

The developer agitation shaft 6 is provided on the upper side of the screw 7 with respect to the partition wall 2*c*. Then, the developer agitation shaft 6 rotates in a direction indicated by an arrow R2. Further, an agitation region R in which the developer T within the developer container 2 and the developer T newly supplied from the developer supply device 30 arranged on the upper side of the developer container 2 are agitated is formed inside the developer container 2.

The supply roller 3 for supplying and collecting the developer T is arranged on the lower side of the screw 7 with being in contact with the developing roller 4. The supply roller 3 is an elastic roller formed of an elastic foam material. Further, the supply roller 3 rotates in a direction opposite to the rotation direction of the developing roller 4 at a nip between the supply roller 3 and the developing roller 4.

The blade 5 serving as an elastic regulation member is provided in the developer container 2 in such a manner as to apply pressure to the developing roller 4. The blade 5 is a metallic plate spring that is in contact with the developing roller 4 at a predetermined contact pressure. Further, at this time, due to the friction generated between the respective surfaces of the developing roller 4 and the blade 5, an electric charge sufficient for the development is applied to the developer T.

Thereafter, according to the rotation of the developing roller 4, the developer T adhering to the circumferential surface of the developing roller 4 is conveyed to a development region (i.e., development nip) N where the photosensitive drum 9 and the developing roller 4 are in contact with each other. Then, the developer T makes contact with the photosensitive drum 9 at the development region N. In other words, in order to form a development field between the photosensitive drum 9 and the developing roller 4, a power source (not illustrated) is connected to the developing roller 4. As a result, the developer T on the circumferential surface of the developing roller 4 is transferred to the photosensitive drum 9 by the action of the development field. Through this operation, a developer image is formed according to the electrostatic latent image formed on the photosensitive drum 9. In other words, the electrostatic latent image is visualized.

Further, the developer T that is conveyed to the development nip N but remains being borne on the circumferential surface of the developing roller 4 without contributing to the development is scraped from the circumferential surface of the developing roller 4 by the friction between the developing roller 4 and the supply roller 3. Thereafter, part of the developer T that is scraped is supplied to the developing roller 4 by the supply roller 3 again together with the developer T newly supplied to the circumferential surface of the supply roller 3. The remaining developer T is returned to the developer container 2.

<Developer Supply Device and Developing Device>

Subsequently, the developer supply device 30 will be described. As illustrated in FIGS. 1 and 2, the developer supply device 30 configured separately from the process cartridge 10 is provided on the upper side of the developer container 2. An agitation member 32, a screw 33, and a developer supply opening 34 are provided inside a developer storage portion 31 of the developer supply device 30. The agitation member 32 is provided for loosening the developer T within the developer storage portion 31. The screw 33 supplies the developer T from the developer storage portion 31 to the agitation chamber 2*b*. The developer supply opening 34 is provided at a position where the developer supply opening 34 fits a developer reception agitation opening 2*f* provided at the upper portion of the developer container 2, when the developer supply device 30 is attached to the main unit of the image forming apparatus.

The agitation member 32 and the screw 33 are rotatably supported by the developer storage portion 31 at both ends thereof, so as to be driven to rotate according to a supply instruction from the image forming apparatus main unit. The agitation member 32 includes a rotation shaft 32*a* serving as a base member and an agitation plate 32*b* formed of a flexible sheet member. An outer portion of the screw 33 is formed in a spiral rib shape.

Then, based on the information from a remaining developer amount detection unit 11, a developer supply control device (not illustrated) issues an instruction when it is determined that the developer T has to be supplied to the developing device 1 from the developer supply device 30. Then, the screw 33 is driven by the rotation of a drive coupling (not illustrated). The developer T is conveyed toward the developer supply opening 34 according to the rotation of the screw 33, and caused to freely fall from the developer supply opening 34. With this configuration, the developer T is supplied via the developer reception agitation opening 2*f* of the process cartridge 10, so that the amount of the developer T within the developer container 2 can be constantly maintained at a predetermined amount.

Next, circulation of the developer T within the developer container 2 according to the present exemplary embodiment will be described with reference to the longitudinal cross-sectional view of the developing device 1 and the developer supply device 30 in FIG. 2.

The developer agitation shaft 6 and the screw 7 are arranged inside the developer container 2 as components for circulating the developer T. The developer T supplied from the developer reception agitation opening 2*f* is agitated and conveyed by the developer agitation shaft 6, and supplied to the development chamber 2*a* from the downstream opening 2*e*1. The developer T within the development chamber 2*a* is conveyed in the longitudinal single direction by the screw 7 serving as a longitudinal conveyance member. Then, the developer T is conveyed to the agitation chamber 2*b* from the upstream opening 2*e*2 by the conveyance pressure of the screw 7. Thereafter, the developer T is supplied to the developing roller 4 again while being conveyed in the longitudinal center direction in the development chamber 2*a* by the screw 7. With this configuration, the developer T circulates through the agitation chamber 2*b* and the development chamber 2*a* in the developer container 2.

Hereinafter, a first exemplary embodiment of the present invention will be described in detail with reference to the longitudinal cross-sectional view of the developing device 1 and the developer supply device 30 in FIG. 2. The developer T supplied from the developer reception agitation opening 2*f* of the developer supply device 30 is distributed to the upstream and the downstream sides in the conveyance direction of the developer T by conveyance blades 12 and 13. The developer T is conveyed to the downstream side by the conveyance blade 13 to make a bulge within the agitation chamber 2*b*. The developer agitation shaft 6 rotates to horizontally smooth the bulge of developer T. By repeating this operation, the developer T gradually spreads across the agitation chamber 2*b* so as to be conveyed to the downstream opening 2*e*1. Then, the developer T falls from the downstream opening 2*e*1 into the development chamber 2*a* by the gravitational force. Thereafter, the developer T is supplied to the developing roller 4 while being conveyed in the longitudinal center direction (direction indicated by an arrow) in the development chamber 2*a* by the screw 7. When the development chamber 2*a* becomes full, the developer T is conveyed to the agitation chamber 2*b* from the upstream opening 2*e*2 by the conveyance pressure of the screw 7. The developer T conveyed to the agitation chamber 2*b* is accumulated on the remaining developer amount detection unit 11 by the conveyance force toward the upstream side by the conveyance blade 12. The remaining developer amount detection unit 11 becomes full when a predetermined amount of developer T is accumulated, so that the developer supply control device (not illustrated) stops supplying the developer T from the developer reception agitation opening 2*f* of the developer supply device 30. Even if the remaining developer amount detection unit 11 has become full, the developer T is conveyed in the downstream direction while going over the conveyance blade 12 because the conveyance force of the conveyance blade 12 is smaller than the conveyance force of the screw 7. Therefore, the developer T will not be stagnated or jammed. The above-described operation is executed repeatedly, so that the developer T circulates through the agitation chamber 2*b* and the development chamber 2*a*.

Figure 3:
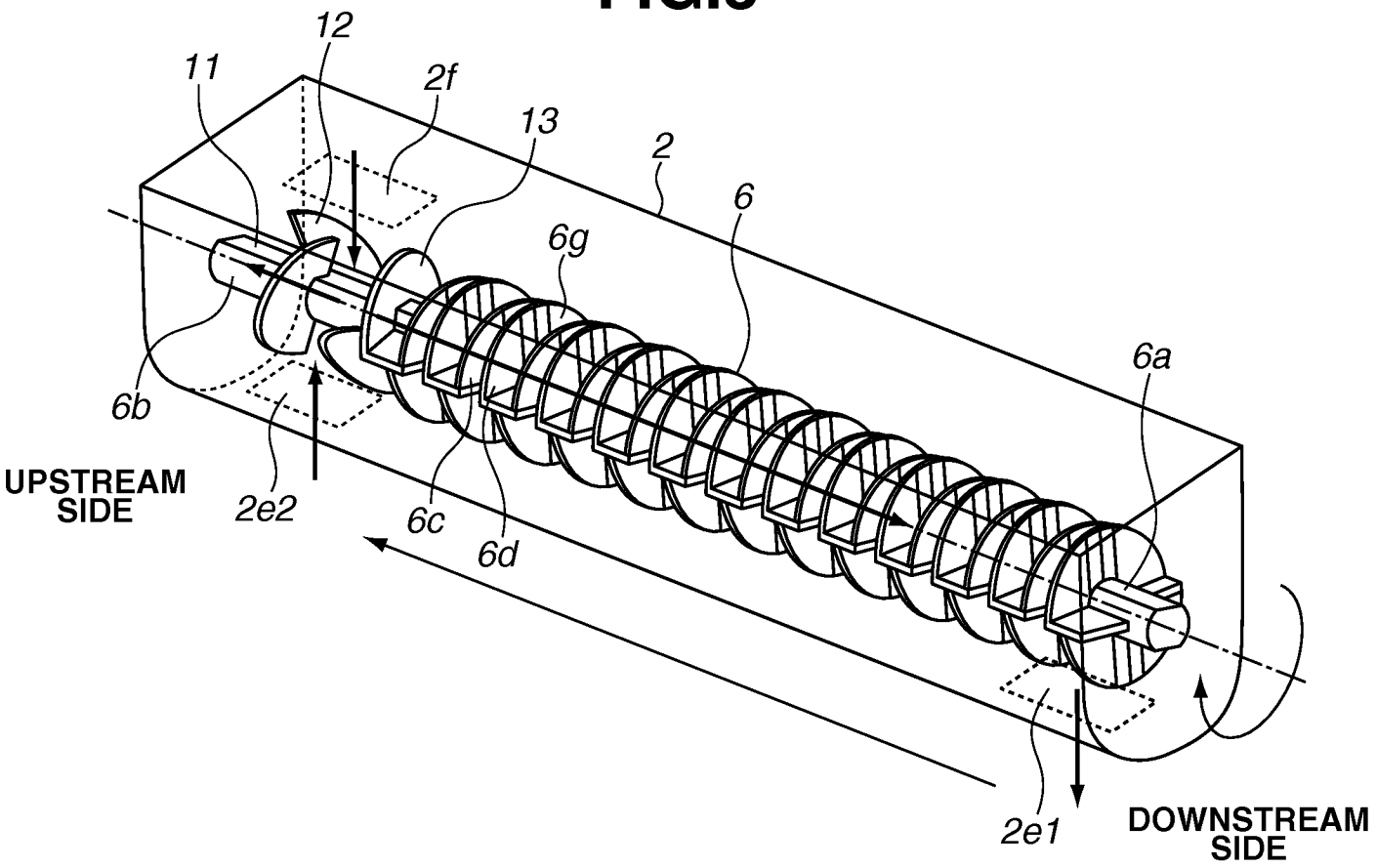
FIG. 3 is an external perspective view of a developer agitation shaft.

Next, a configuration of the developer agitation shaft 6 will be specifically described with reference to FIG. 3. FIG. 3 is a perspective view illustrating the developer agitation shaft 6 in the developing device 1. The developer agitation shaft 6 is an integral injection-molded component including the remaining developer amount detection unit 11, the conveyance blades 12 and 13, supporting portions 6*a* and 6*b*, trap agitation blades 6*c* and 6*d*, an inverse agitation blade 6*e* (FIG. 4A), an agitation collection portion 6*f* (FIG. 4C), and an agitation blade supporting point 6*g*. The developer agitation shaft 6 has a length corresponding to a length in the longitudinal direction of the developer container 2, so that the developer agitation shaft 6 can agitate and convey the developer T across the entire region in the longitudinal direction of the developer container 2. The developer agitation shaft 6 includes the supporting portions 6*a* and 6*b* serving as rotation members. The supporting portions 6*a* and 6*b* are rotatably supported by the respective walls at both ends of the developer container 2. Herein, an axis line (a dashed-dotted line illustrated in FIG. 3) of the rotation axis of the developer agitation shaft 6 (supporting portions 6*a* and 6*b*) is parallel to the longitudinal direction of the developer container 2. The supporting portions 6*a* and 6*b* are driven to rotate by a driving mechanism (not illustrated), so that the developer agitation shaft 6 rotates about the axis line (supporting portions 6*a* and 6*b*) in a direction indicated by an arrow in FIG. 3.

Figure 4A:
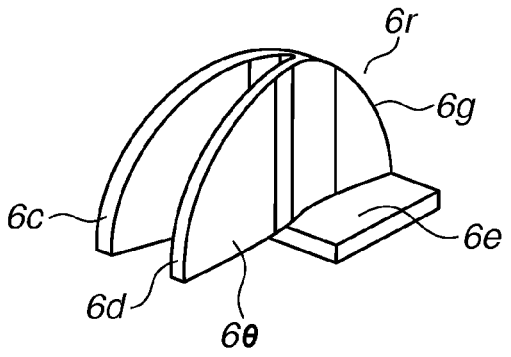
FIGS. 4A, 4B, and 4C are perspective views illustrating shape characteristics of the developer agitation shaft according to a first exemplary embodiment.
Figure 4B:
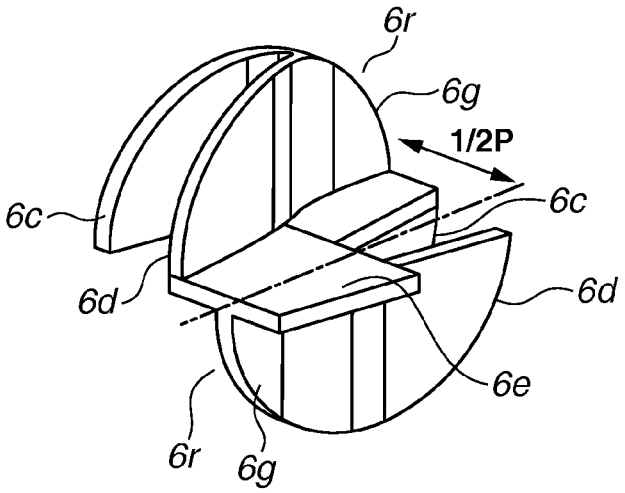
Figure 4C:
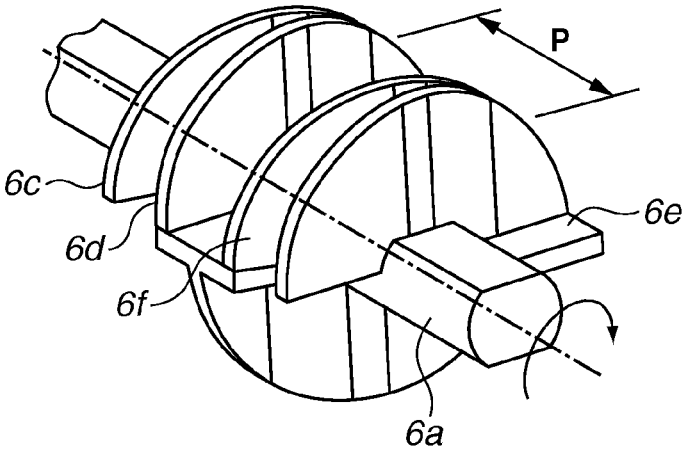

Subsequently, a design structure of an agitation blade portion of the developer agitation shaft 6 will be described with reference to FIGS. 4A, 4B, and 4C. FIGS. 4A to 4C are partial perspective views illustrating a design structure of the agitation blade portion in the developer agitation shaft 6. The developer agitation shaft 6 is rotatably provided in the agitation chamber 2*b* serving as a developer storage portion in the developer container 2. As the agitation blades for agitating the developer T within the agitation chamber 2*b*, the developer agitation shaft 6 includes a plurality of semicircular trap agitation blades 6*c* and 6*d* arranged in the axis direction of the developer agitation shaft 6, and each of the trap agitation blades 6*c* and 6*d* is disposed in a direction intersecting with the axis direction thereof as illustrated in FIG. 4A. Then, two trap agitation blades 6*c* and 6*d* adjacent in the axis direction of the developer agitation shaft 6 make a set to constitute an agitation blade portion 6*r*. The two trap agitation blades 6*c* and 6*d* adjacent in the axis direction that constitute the agitation blade portion 6*r* are disposed with inclination of a specific angle 6θ so that a space therebetween becomes gradually wider upstream with respect to the rotation direction of the developer agitation shaft 6, starting from the agitation blade supporting point 6*g* as a starting point. Further, as the agitation blade, the developer agitation shaft 6 includes the inverse agitation blade 6*e* arranged in the axis direction of the developer agitation shaft 6. The inverse agitation blade 6*e* is disposed only on one side from the center of the semicircular shape.

A plurality of agitation blade portions 6*r* each including two trap agitation blades 6*c* and 6*d* adjacent in the axis direction is arranged with being shifted from one another in a circumferential direction and a longitudinal direction of the developer agitation shaft 6. In the present exemplary embodiment, as illustrated in FIG. 4B, the agitation blade portions 6*r* illustrated in FIG. 4A are separately arranged at a pitch of 180 degrees in the circumferential direction of the developer agitation shaft 6. Further, as illustrated in FIG. 4C, the agitation blade portions 6*r* are arranged with being shifted from one another by a half pitch in the longitudinal direction (axis direction), in connection with one another with the supporting portion 6*a* (6*b*) being a center. In addition, in light of limitation on strength of a mold for molding the agitation collection portion (root portion) 6*f* between the trap agitation blades 6*c* and 6*d*, a Y-shape having an angle formed by the trap agitation blades 6*c* and 6*d* and the agitation blade supporting point 6*g* and having a side surface formed into a smooth rounded (R) surface in the present invention is employed.

Figure 5A:
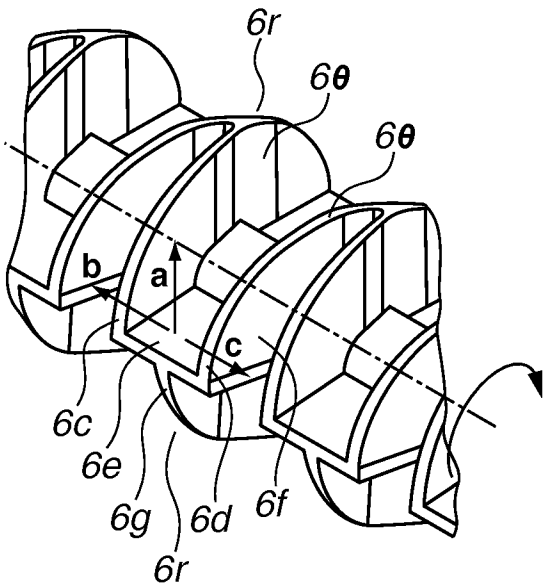
FIGS. 5A, 5B, and 5C are diagrams schematically illustrating a state where developer is agitated by the developer agitation shaft according to the first exemplary embodiment.
Figure 5B:
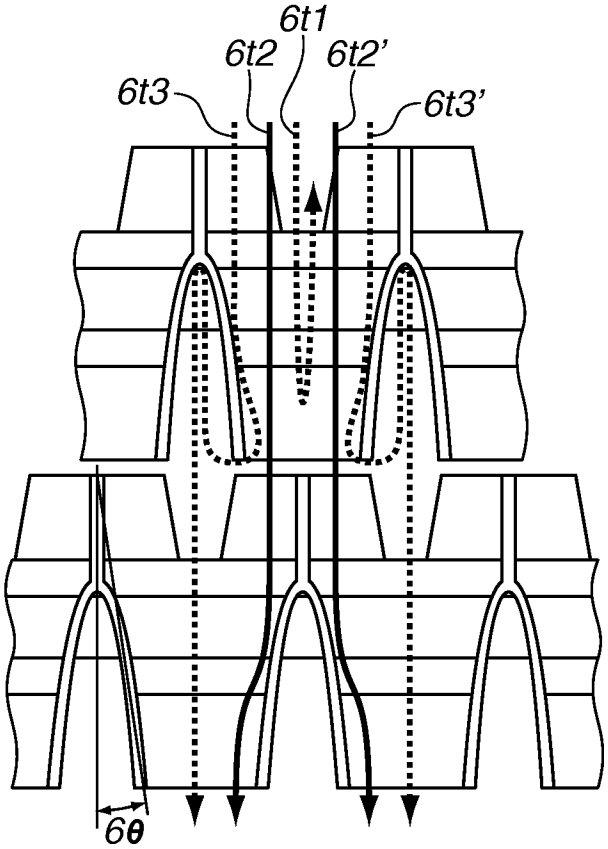

Subsequently, dimensions of respective portions will be described. Unlike the component such as a screw, there is comparatively no limitation in size of the trap agitation blades 6*c* and 6*d*. Therefore, in the present exemplary embodiment, the outer diameter of the trap agitation blade 6*c* (6*d*) has a radius of 14 mm (R14). Accordingly, it is possible to design a large-capacity developer agitation shaft in spite of a compact design. Further, as illustrated in FIG. 5B, in the present exemplary embodiment, of the agitation blade portions 6*r* adjacent in the circumferential direction of the developer agitation shaft 6, a trap agitation blade 6*c* of one agitation blade portion 6*r* and a trap agitation blade 6*d* of the other agitation blade portion 6*r* that are adjacent in the axis direction are arranged at an angle so as not to overlap with each other in an agitation region when rotating. However, of the agitation blade portions 6*r* adjacent in the circumferential direction of the developer agitation shaft 6, the trap agitation blade 6*c* of the one agitation blade portion 6*r* and the trap agitation blade 6*d* of the other agitation blade portion 6*r* that are adjacent in the axis direction may be arranged at an angle so as to overlap with each other in the agitation region when rotating. For example, an inclination angle 6θ between each of the two trap agitation blades 6*c* and 6*d* and the agitation blade supporting point 6*g* is set so that the trap agitation blades 6*c* and 6*d* overlap with each other by an amount at least equal to or greater than a thickness thereof when the trap agitation blades 6*c* and 6*d* make a half-turn. Specifically, the inclination angle 6θ of each of the trap agitation blades 6*c* and 6*d* can be optionally set within a range of about 3 degrees to 12 degrees according to required agitation capability. For example, the respective inclination angles 6θ of both the trap agitation blades 6*c* and 6*d* at both sides may be symmetrically set to 8 degrees. Further, a pitch P illustrated in FIG. 4C can be optionally set according to the agitation capability. For example, the pitch P can be set to 18 mm. The above-described configuration has a certain effect, and thus the present invention can be implemented.

According to the features of the developer agitation shaft 6 having the above-described configurations, when the developer agitation shaft 6 is rotated about the rotation axis in a direction indicated by an arrow in FIG. 4C, the developer T can be trapped by the trap agitation blades 6*c* and 6*d* and efficiently agitated by the inverse agitation blade 6*e*.

<Functions of First Exemplary Embodiment>

Figure 5C:
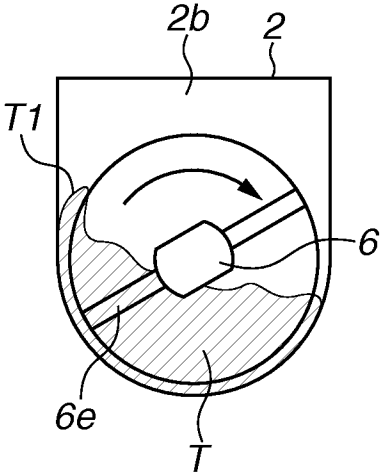

Subsequently, functions of the trap agitation blades 6*c* and 6*d*, and the inverse agitation blade 6*e* that are disposed on the developer agitation shaft 6 will be described with reference to FIGS. 5A, 5B, and 5C. FIG. 5A is a partial perspective view simply illustrating, by arrows a, b, and c, moving directions of the developer T when the developer agitation shaft 6 rotates. FIG. 5B is a top view illustrating the agitation blade portions 6*r* disposed on a plane at a pitch of 180 degrees in the rotation direction and continuous movement of the developer T in an easy-to-understand manner. Respective arrows 6*t*1, 6*t*2, 6*t*3, 6*t*2', and 6*t*3' in FIG. 5B indicate continuous movements of the developer T when the developer agitation shaft 6 makes a full-turn, and the movements indicated by the arrows 6*t*2 and 6*t*2', and the movements indicated by the arrows 6*t*3 and 6*t*3' are symmetrical about the movement indicated by the arrow 6*t*1. FIG. 5C is a schematic cross-sectional view illustrating a movement of the developer T when the developer agitation shaft 6 is rotating.

A first feature will be described. When the semicircular trap agitation blades 6*c* and 6*d* constituting the agitation blade portion 6*r* are disposed in a direction in which a space therebetween becomes gradually wider upstream with respect to a rotation direction, it is possible to acquire a first effect in which the agitation residual developer T can be eliminated. Because the semicircular trap agitation blades 6*c* and 6*d* can rotate with the loci where the trap agitation blades 6*c* and 6*d* do not pass the same place at a cycle of 180 degrees when rotating, it is possible to prevent unevenness caused by residual developer T that is not scraped off from a wall surface of the developer container 2.

Although the developer T can be sufficiently agitated only by the first feature, the present exemplary embodiment further includes the following features.

Next, a second feature will be described. With the combination of the trap agitation blades 6*c* and 6*d* that make a set to constitute the agitation blade portion 6*r* and the inverse agitation blade 6*e*, the developer T can be inversely agitated while being scraped and collected. Therefore, it is possible to acquire another effect in which complex agitation flows indicated by arrows in FIGS. 5A and 5B are generated in the developer T newly supplied from the developer reception agitation opening 2*f* and the old developer T returned from the upstream opening 2*e*2, so that the agitation capability for the developer T can be improved.

Next, a third feature will be described. The agitation blade portions 6*r*, each of which is constituted by a set of two trap agitation blades 6*c* and 6*d*, and which are disposed at a half pitch (½P) in the longitudinal direction of the developer agitation shaft 6 are alternately arranged at a pitch of 180 degrees in the rotation direction. With this configuration, the agitation region is divided at the central portion thereof, so that the developer T can be agitated alternately. As a result, the developer T is agitated efficiently, and thus the developer T can be uniformly agitated without agitation unevenness or agitation residual.

Next, a fourth feature will be described. Because the adjacent trap agitation blades 6*c* and 6*d* that make a set to constitute the agitation blade portion 6*r* are disposed at an angle, the agitation collection portion 6*f* between the trap agitation blades 6*c* and 6*d* is a space portion without having the inverse agitation blade 6*e*. This space portion is characterized in that an atmospheric pressure thereof tends to decrease when the developer agitation shaft 6 is rotated in a direction indicated by an arrow in FIG. 5C and the inverse agitation blade 6*e* accordingly protrudes from a developer surface T1. The inverted developer T is thereby taken into the space portion (refer to the arrows 6*t*3 and 6*t*3' in FIG. 5B). As a result, the agitated developer T is evenly distributed to the right and the left regions without excessively going over the downstream trap agitation blades 6*c* and 6*d*, and thus it is possible to stabilize the agitation capability.

Description will be given of the specific movement of the developer T when the inverse agitation blade 6*e* having the above-described features are continuously rotated. As illustrated in FIG. 5C, in a region where the developer T exists, the trap agitation blades 6*c* and 6*d* scrape and collect the developer T, and the inverse agitation blade 6*e* inverts the developer T. At the instant of the inverse agitation blade 6*e* protruding from the developer surface (atmosphere surface) T1, the developer T is agitated in an inverse direction (indicated by an arrow "a"), an upstream direction (indicated by an arrow "b"), and a downstream direction (indicated by an arrow "c") that are indicated in FIG. 5A. Typical continuous movements of the developer T are indicated by the arrows 6*t*1, 6*t*2, and 6*t*3 in FIG. 5B. Applying complex agitation flows to the developer T increases chances of the new/old developer T contacting each other. When the above-described operation is repeated by the number of pitches P in the longitudinal direction, the agitation can be efficiently executed in an agitation-target region within a small amount of time.

According to the present exemplary embodiment, the components constituting the developer agitation shaft 6 are integrated, so that the number of components can be reduced in comparison to that of the conventional technique. As a result, the cost such as component cost, assembly cost, and production management cost can be reduced significantly, and thus it is possible to provide a low cost developing device.

Further, because agitation blade portions 6*r* each constituted by a set of semicircular trap agitation blades 6*c* and 6*d* are alternately arranged at a pitch of 180 degrees in the circumferential direction of the rotation axis, the developer T can be conveyed and agitated at every single pitch P. With this configuration, with respect to the new developer T supplied from the developer reception agitation opening 2*f* illustrated in FIG. 3 and the old developer T supplied from the upstream opening 2*e*2 illustrated in FIG. 3, insufficient agitation of the developer T caused by excess inflow of the developer T to the downstream side can be prevented. As a result, the developer T within the developer container 2 can be agitated uniformly, and thus image defect such as density unevenness can be prevented from occurring.

Further, in the present exemplary embodiment, because the inclination angles 6θ of the trap agitation blades 6*c* and 6*d* are set to be symmetrical and equal, the developer agitation shaft 6 of the agitation chamber 2*b* does not have a force for conveying the developer T in the longitudinal direction. Therefore, although the developer container 2 is configured to cause the developer T to circulate through the development chamber 2*a* and the agitation chamber 2*b* in the arrow direction as illustrated in FIG. 2, it is possible to intentionally cause the developer T to stay at the agitation chamber 2*b* for long time. Accordingly, it is possible to agitate the developer T supplied to the agitation chamber 2*b* together with the developer T existing in the developer container 2 for long time. Accordingly, the developer T can be supplied to the developing roller 4 after the developer T existing in the developer container 2 and the newly-supplied developer T are agitated sufficiently. With this configuration, image defect arising from the insufficient agitation of the developer T can be prevented from occurring.

Figure 6A:
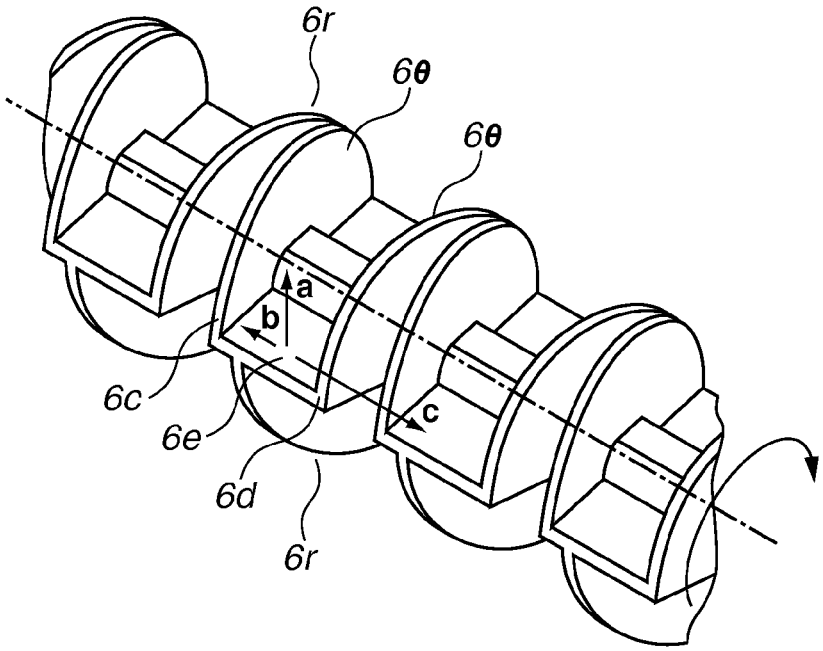
FIGS. 6A and 6B are diagrams illustrating shape characteristics of a developer agitation shaft according to a second exemplary embodiment.
Figure 6B:
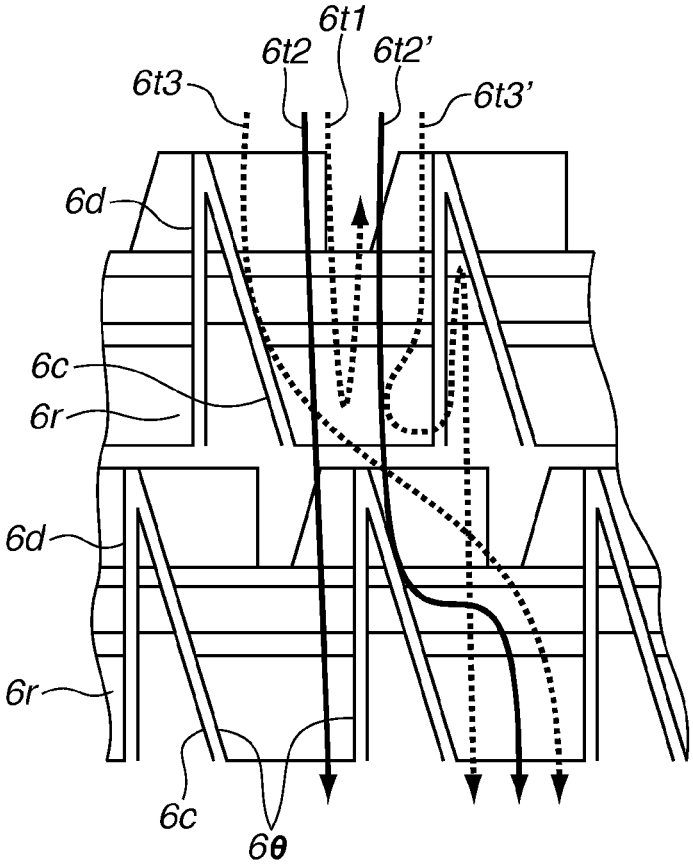

Hereinafter, a second exemplary embodiment will be described with reference to FIGS. 6A and 6B. FIGS. 6A and 6B are explanatory diagrams of a developer agitation shaft 6 according to the present exemplary embodiment. FIG. 6A is a partial perspective view of the developer agitation shaft 6, and FIG. 6B is a top view illustrating the agitation blade portions 6*r* disposed on a plane at a predetermined pitch in the rotation direction and continuous movements of the developer T. In the present exemplary embodiment, only configurations different from those described in the first exemplary embodiment will be described, and description of the same configurations will be omitted.

In the above-described first exemplary embodiment, the inclination angles 6θ of the trap agitation blades 6*c* and 6*d* have been set to be symmetrical to each other. However, in the present exemplary embodiment, the inclination angles 6θ of the trap agitation blades 6*c* and 6*d* are set to be asymmetrical to each other. The inclination angles 6θ of the trap agitation blades 6*c* and 6*d* according to the present exemplary embodiment are set in such a manner that the agitation regions of the trap agitation blades 6*c* and 6*d* arranged to face each other in the circumferential direction of the developer agitation shaft 6 overlap with each other when the developer agitation shaft 6 makes a full-turn. In other words, of the agitation blade portions 6*r* adjacent in the circumferential direction of the developer agitation shaft 6, a trap agitation blade 6*c* of one agitation blade portion 6*r* and a trap agitation blade 6*d* of the other agitation blade portion 6*r* that are adjacent in the axis direction are preferably arranged at an angle to overlap with each other in the agitation regions when rotating.

By changing the inclination angles 6θ of the trap agitation blades 6*c* and 6*d*, the developer agitation shaft 6 can be provided with a conveyance force. While the developer T is agitated in an inverse direction (indicated by an arrow "a"), an upstream direction (indicated by an arrow "b"), and a downstream direction (indicated by an arrow "c") that are illustrated in FIG. 6A, the conveyance force can be adjusted by changing the inclination angles 6θ to make the forces for flowing in the upstream direction and the downstream direction asymmetrical to each other. However, similar to the configuration described in the first exemplary embodiment, the semicircular trap agitation blades 6*c* and 6*d* are arranged in a direction in which a space therebetween becomes gradually wider upstream with respect to the rotation direction.

The continuous movement of the developer T at the time of rotating the developer agitation shaft 6 will be specifically described with reference to FIG. 6B. Respective arrows 6*t*1, 6*t*2, 6*t*3, 6*t*2', and 6*t*3' illustrated in FIG. 6B indicate the continuous movements of developer T when the developer agitation shaft 6 makes a full-turn, and the movements indicated by the arrows 6*t*2 and 6*t*2' and the movements indicated by the arrows 6*t*3 and 6*t*3' are asymmetrical about the movement indicated by the arrow 6*t*1. The inclination angle 6θ of the trap agitation blade 6*c* that has been set to 8 degrees in the first exemplary embodiment is set to 16 degrees in the present exemplary embodiment, and the inclination angle 6θ of the trap agitation blade 6*d* that has been set to minus 8 degrees in the first exemplary embodiment is set to 0 degree in the present exemplary embodiment. As a result, the developer T agitated by the trap agitation blade 6*c* flows in a direction indicated by the arrow 6*t*3, so that a ratio of the developer T flowing to the downstream side is increased.

Figure 10A:
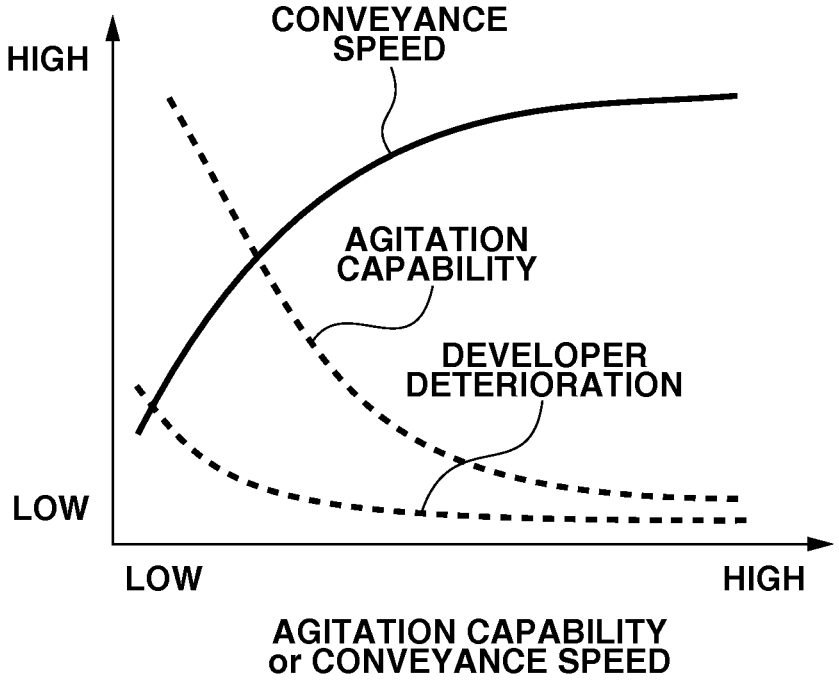
FIGS. 10A and 10B are diagrams illustrating an overview of deterioration of developer, agitation capability, and conveyance speed that are limited by the shape of the developer agitation shaft.
Figure 10B:
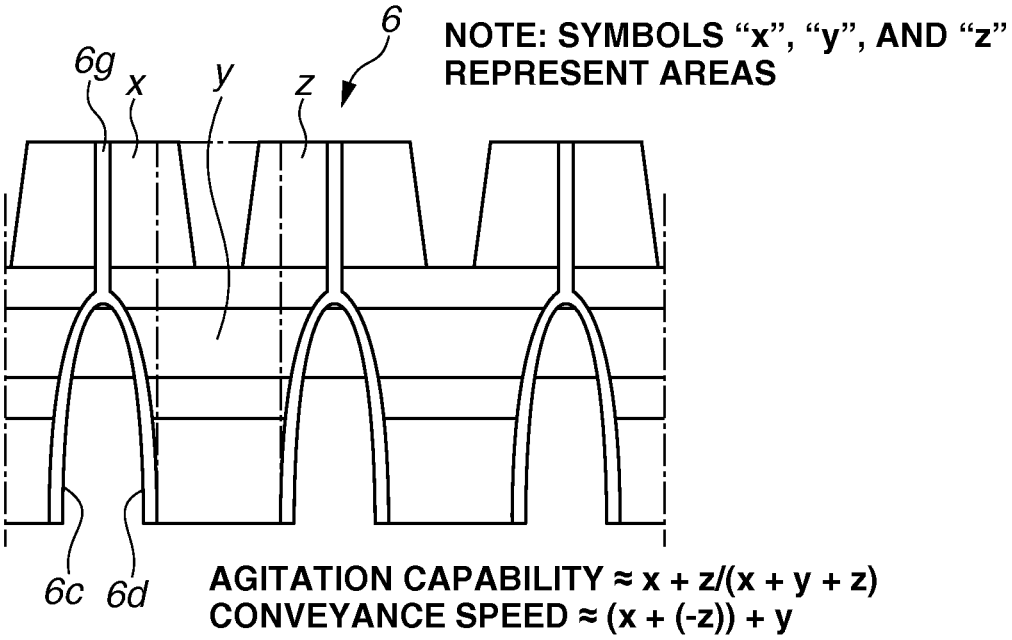
Figure 11:
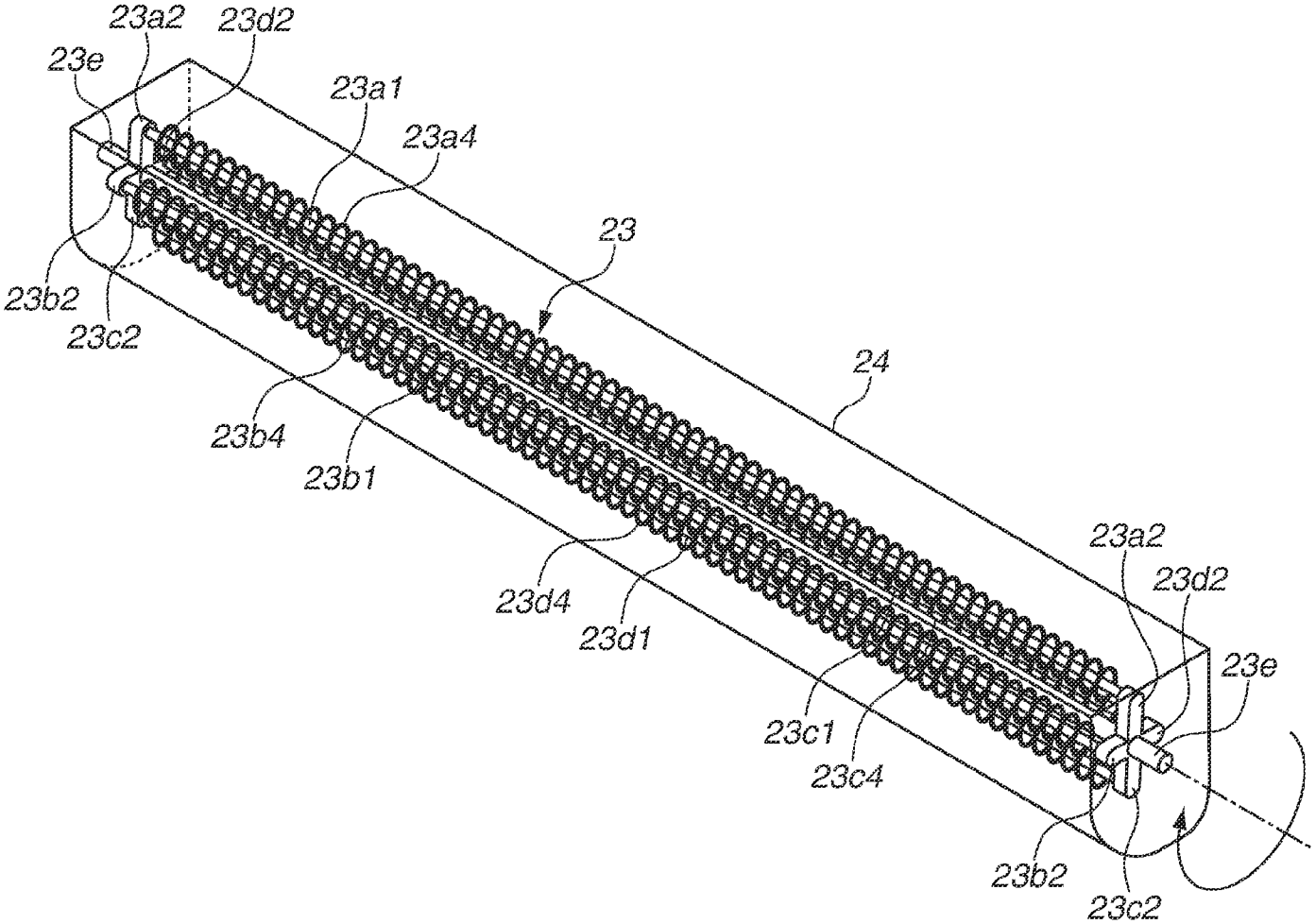
Prior Art FIG.11
FIG. 11 is an external perspective view of a developer agitation member according to a conventional developing device.

As a result, by appropriately setting and making the inclination angles 6θ of the trap agitation blades 6*c* and 6*d* asymmetrical to each other, it is possible to provide a shape design capable of fine adjustments of the conveyance speed and the agitation capability. A specific relationship between the conveyance speed, the agitation capability, and the deterioration of developer T is schematically illustrated as a graph in FIG. 10. By making a fine adjustment of the inclination angle 6θ of the trap agitation blade 6*c* (6*d*), the conveyance speed and the agitation capability can be controlled according to the deterioration of developer T. Accordingly, in contrast to a general screw provided for the purpose of conveyance, there can be provided the developer agitation shaft 6 that balances the conveyance speed with the agitation capability.

Further, injection molding of a screw being a general conveyance member has a limitation such as a long molding cycle because the injection molding thereof is executed through a four-partitioned mold, and a problem such as an uneven thick portion is likely to occur in its molding process. However, according to the present exemplary embodiment, the developer agitation shaft 6 has a shape that can be manufactured easily. Therefore, the developer agitation shaft 6 can be easily manufactured through a general and simple injection molding process at low cost.

Furthermore, by a transportation impact arising in a transportation period of the shipment of finished products, a problem in which the developer is tapped and cohered together may occur. In order to cope with the above-described phenomenon, the developer agitation shaft 6 has to be provided with rotation intensity for loosening the cohered developer. According to the present exemplary embodiment, the rotation intensity of the developer agitation shaft 6 can be improved, and thus it is possible to take a countermeasure against cohesion of developer.

Figure 7A:
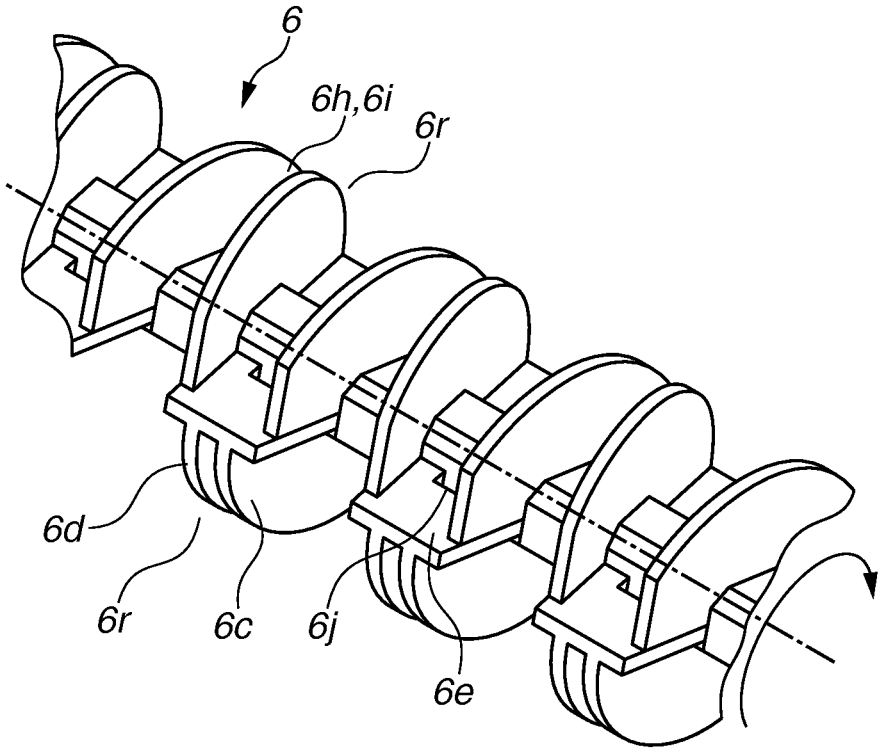
FIGS. 7A and 7B are diagrams illustrating shape characteristics of a developer agitation shaft according to a third exemplary embodiment.
Figure 7B:
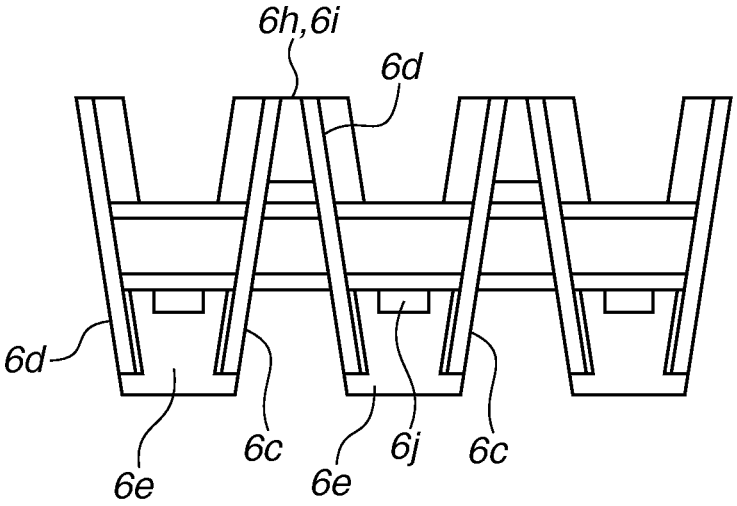

Hereinafter, a third exemplary embodiment of the present invention will be described with reference to FIGS. 7A and 7B. FIGS. 7A and 7B are explanatory diagrams of a developer agitation shaft 6 according to the present exemplary embodiment. FIGS. 7A and 7B are a partial perspective view and a top plan view, respectively, of the developer agitation shaft 6. In the present exemplary embodiment, only configurations different from those described in the first exemplary embodiment will be described, and description for the same configurations will be omitted.

In the present exemplary embodiment, an agitation blade supporting point 6*h* having a shape different from that of the agitation blade supporting point 6*g* described in the first exemplary embodiment is employed. The developer agitation shaft 6 according to the present exemplary embodiment is formed into a shape having a cutout portion 6*i* and a square hole 6*j*. The configurations other than the cutout portion 6*i* and the square hole 6*j* are the same as the developer agitation shaft 6 described in the first exemplary embodiment. Next, functions of respective portions will be described.

The agitation blade supporting point 6*h* is formed into a top of a shape in which a gap is provided in the first exemplary embodiment. In the present exemplary embodiment, the two trap agitation blades 6*c* and 6*d* adjacent in the axis direction that constitute the agitation blade portions 6*r* are provided with the cutout portions 6*i* on a side (i.e., a side of the agitation blade supporting point 6*h*) having a narrower gap. Further, the square hole 6*j* is provided on the inverse agitation blade 6*e* arranged at a position between two trap agitation blades 6*c* and 6*d* adjacent in the axis direction and having the cutout portions 6*i*. With this configuration, limitations relating to the mold intensity when producing a mold for an injection-molded component can be eliminated, and thus the developer agitation shaft 6 can be manufactured easily.

Next, a function of the cutout portion 6*i* will be described. Because a gap caused by the cutout portion 6*i* is provided on a side of the agitation blade supporting point 6*h*, the above-described action of taking the developer T into the space portion by the change in atmospheric pressure in the agitation collection portion 6*f* decreases by half. In a case where the developer T is taken into the space portion by the change in atmospheric pressure, there arises a disadvantageous phenomenon in which the developer T is conveyed while going over the downstream trap agitation blade 6*c* (6*d*) when the developer agitation shaft 6 is rotated. The above-described cutout portion 6*i* is provided as a countermeasure against the phenomenon, so that the developer T can be prevented from flowing in the lateral direction. In the present exemplary embodiment, the cutout portion 6*i* is set to 2 mm in order to prevent the developer T from flowing in the lateral direction.

Next, a function of the square hole 6*j* will be described. There arises a difference in flow property (slipperiness) of the developer T due to a difference in friction coefficients thereof. There may be a case where the conveyance distance of the developer T is changed by the difference in flow property, so that the developer T is conveyed at higher speed. The square hole 6*j* is provided on the inverse agitation blade 6*e*, as a unit for making a fine adjustment. With this configuration, it is possible to make a fine adjustment of the conveyance distance of the developer T.

According to the present exemplary embodiment, by making fine adjustments of the trap agitation blade 6*c* (6*d*) and the inverse agitation blade 6*e* disposed on the developer agitation shaft 6, the conveyance speed and the agitation capability can be flexibly designed. As a result, in contrast to a general screw provided for the purpose of conveyance, there can be provided the developer agitation shaft 6 that balances the conveyance capability with the agitation capability.

Figure 8A:
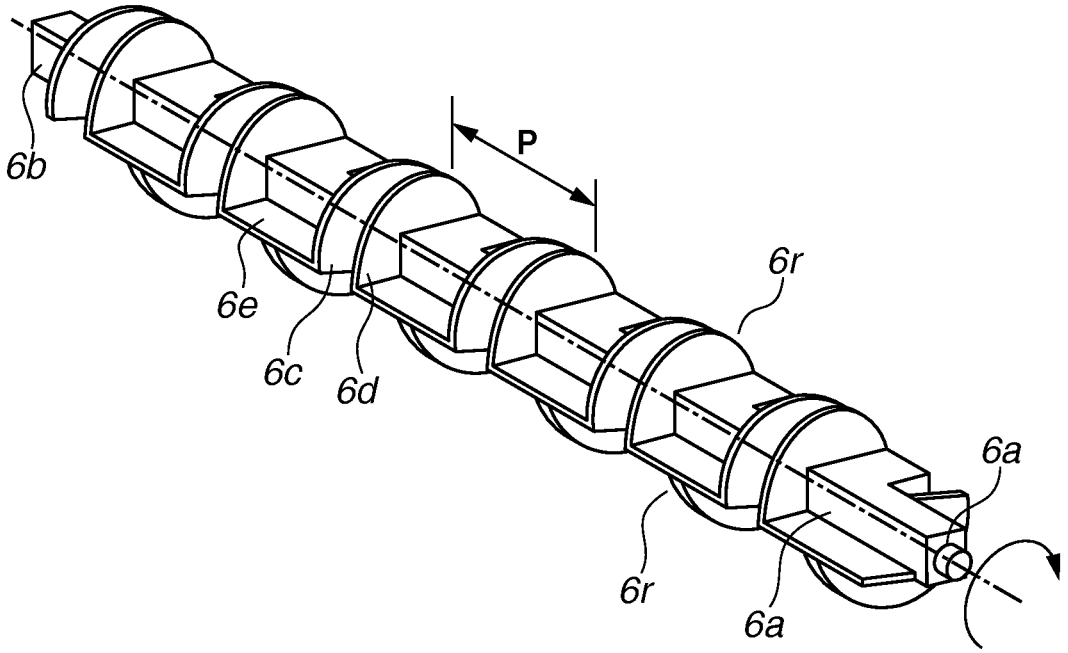
FIGS. 8A and 8B are diagrams illustrating shape characteristics of a developer agitation shaft according to a fourth exemplary embodiment.
Figure 8B:
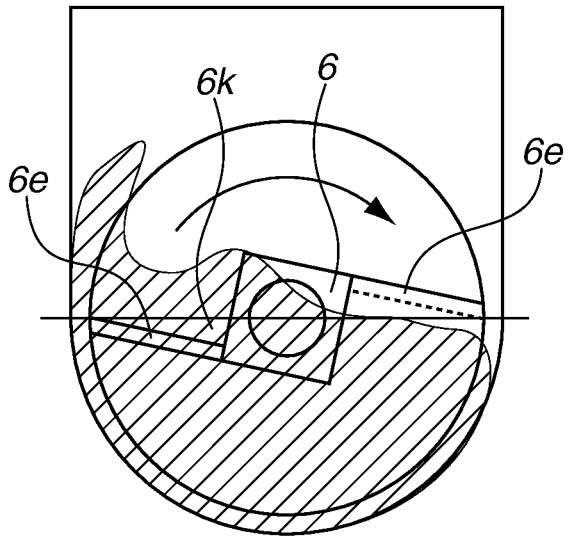

Hereinafter, a fourth exemplary embodiment of the present invention will be described with reference to FIGS. 8A and 8B. FIGS. 8A and 8B are explanatory diagrams of a developer agitation shaft 6 according to the present exemplary embodiment. FIGS. 8A and 8B are a partial perspective view and a cross-sectional view, respectively, of the developer agitation shaft 6. In the present exemplary embodiment, only configurations different from those described in the first exemplary embodiment will be described, and description for the same configurations will be omitted.

In the present exemplary embodiment, the supporting portion 6*a* (6*b*) of the developer agitation shaft 6 is formed of a square shaft having a square sectional shape. Then, the inverse agitation blades 6*e* disposed on the square shaft are arranged in parallel to a plane facing a peripheral direction of the square shaft. As a result, in comparison to the configuration illustrated in FIG. 5C, an amount of developer T that can be inverted at the region of an inverse agitation holding portion 6*k* can be increased.

According to the present exemplary embodiment, because the amount of inverted and agitated developer T is increased, chances of the developer T contacting each other is increased, and thus the agitation capability of the inverse agitation blade 6*e* can be improved. Because the agitation capability is improved, a pitch P of the inverse agitation blade 6*e* can be made wider according to the required agitation capability, and thus the number of the inverse agitation blades 6*e* can be reduced. As a result, it is possible to reduce the cost because materials for producing the developer agitation shaft 6 can be reduced.

Figure 9A:
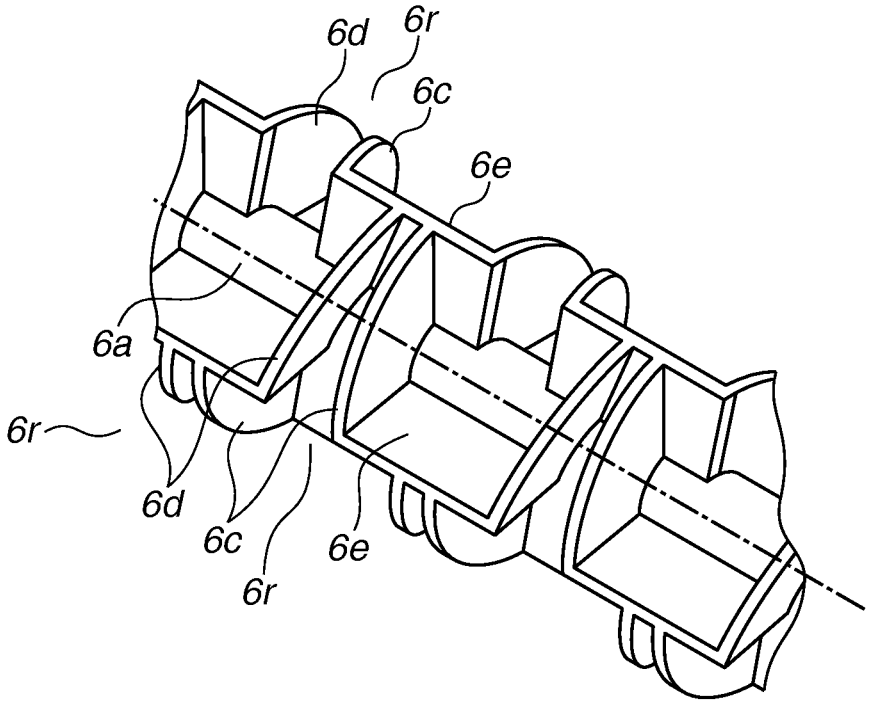
FIGS. 9A and 9B are diagrams illustrating shape characteristics of a developer agitation shaft according to a fifth exemplary embodiment.
Figure 9B:
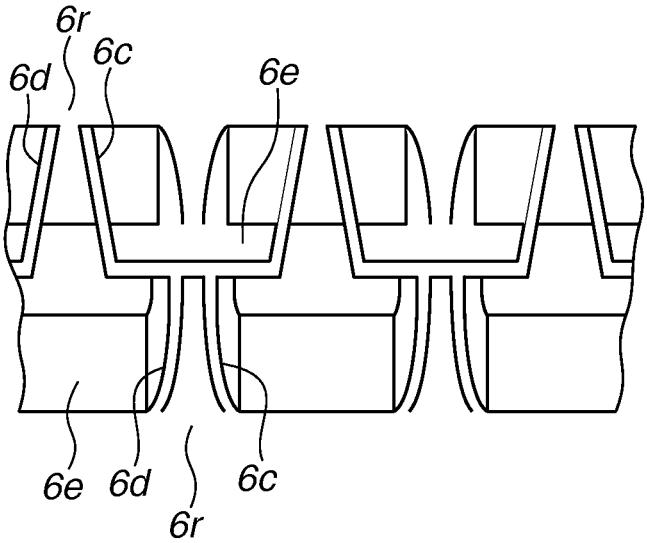

Hereinafter, a fifth exemplary embodiment of the present invention will be described with reference to FIGS. 9A and 9B. FIGS. 9A and 9B are explanatory diagrams of a developer agitation shaft 6 according to the present exemplary embodiment. FIGS. 9A and 9B are a partial perspective view and a top plan view, respectively, of the developer agitation shaft 6. In the present exemplary embodiment, only configurations different from those described in the first exemplary embodiment will be described, and description for the same configurations will be omitted.

In the present exemplary embodiment, the agitation blade portions 6*r*, each of which is constituted by two trap agitation blades 6*c* and 6*d*, and the inverse agitation blade 6*e*, and which are adjacent in the axis direction are separately arranged at a pitch of 90 degrees in the circumferential direction of the supporting portion 6*a* of the developer agitation shaft 6. Further, similar to the above-described exemplary embodiments, the separately-arranged agitation blade portions 6*r* are alternately arranged in the longitudinal direction of the developer agitation shaft 6 with being shifted from one another by a half-pitch in the longitudinal direction.

According to the present exemplary embodiment, it is possible to double the number of inverse agitation blades 6*e* in comparison to the above-described configuration in which the inverse agitation blades 6*e* are arranged at a pitch of 180 degrees. Because the number thereof is doubled, it is also possible to simply double the agitation capability. As a result, the developer agitation shaft 6 having a compact shape can be designed because the agitation capability thereof is improved. Accordingly, it is possible to design a miniaturized developing device.

In the above-described exemplary embodiments, a configuration of a process cartridge that includes a photosensitive drum and a developing device and is detachably attached to an image forming apparatus has been described as an example. However, the configuration is not limited to the above. For example, the present invention is effective also in an image forming apparatus in which constituent members are incorporated, or an image forming apparatus to which constituent members are detachably attached.

Further, in the above-described exemplary embodiments, an image forming apparatus that includes the developing device may be an image forming apparatus such as a printer, a copying machine, or a facsimile, or may be an image forming apparatus such as a multifunction peripheral in which these functions are combined. The similar effect can be acquired by applying the present invention to the developing device used in the above-described image forming apparatuses.

According to an exemplary embodiment of the present invention, it is possible to provide a developing device at the cost lower than in the conventional technique.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-206278, filed Oct. 7, 2014, which is hereby incorporated by reference herein in its entirety.

What is claimed is:

1. A developing device comprising:

a developer storage portion configured to store developer; and a developer agitation portion configured to rotate in the developer storage portion to agitate the developer;

wherein the developer agitation portion includes a plurality of agitation blade portions which include a set of two trap agitation blades adjacent in an axis direction of the developer agitation portion, and the two trap agitation blades are disposed in a direction intersecting with the axis direction, wherein the plurality of agitation blade portions are arranged with being shifted from one another in a circumferential direction and a longitudinal direction of the developer agitation portion, wherein the two trap agitation blades adjacent in the axis direction alternately include an agitation collection portion, a width of which becomes gradually narrower with respect to the rotation direction of the developer agitation portion.

2. The developing device according to claim 1, wherein, of the agitation blade portions adjacent in the circumferential direction of the developer agitation portion, a trap agitation blade of one agitation blade portion and a trap agitation blade of the other agitation blade portion that are adjacent in the axis direction are arranged to overlap with each other in an agitation region when rotating.

3. The developing device according to claim 2, wherein the trap agitation blade of the one agitation blade portion and the trap agitation blade of the other agitation blade portion that are adjacent in the axis direction are arranged to overlap with each other by an amount at least equal to or greater than a thickness of the trap agitation blade in the agitation region when rotating.

4. The developing device according to claim 1, wherein inclination angles of the two trap agitation blades relative to the axis direction that constitute the agitation blade portion, are symmetrical to each other.

5. The developing device according to claim 1, wherein inclination angles of the two trap agitation blades adjacent in the axis direction that constitute the agitation blade portion are asymmetrical to each other.

6. The developing device according to claim 1, wherein the two trap agitation blades overlap each other in the axis direction.

7. The developing device according to claim 1, wherein the agitation blade portions are separately arranged at a pitch of 180 degrees in the circumferential direction of the developer agitation portion, and the separately arranged agitation blade portions are alternately disposed in a longitudinal direction of the developer agitation portion with being shifted from one another by a half pitch in the longitudinal direction.

8. The developing device according to claim 1, wherein the agitation blade portions are separately arranged at a pitch of 90 degrees in the circumferential direction of the developer agitation portion, and the separately arranged agitation blade portions are alternately disposed in a longitudinal direction of the developer agitation portion with being shifted from one another by a half pitch in the longitudinal direction.

9. The developing device according to claim 1, wherein the developer agitation portion includes an inverse agitation blade arranged in the axis direction of the developer agitation portion at a position between the agitation blade portions arranged with being shifted from one another in the circumferential direction, and wherein a space between the two trap agitation blades adjacent in the axis direction that constitute the agitation blade portions, on a side where inclination angles of the two trap agitation blades are spaced further from one another, is a space portion without having the inverse agitation blade.

10. The developing device according to claim 9, wherein the developer agitation portion is a square shaft having a square sectional shape, and the inverse agitation blade is extended parallel to a plane facing a peripheral direction of the square shaft.

11. The developing device according to claim 9, wherein cutout portions are provided on a side where inclination angles of the two trap agitation blades adjacent in the axis direction that constitute the agitation blade portions are narrower, and a hole is provided on the inverse agitation blade arranged at a position between the trap agitation blades adjacent in the axis direction and having the cutout portions.

12. A process cartridge detachably attached to an image forming apparatus, the process cartridge comprising:

an image bearing member;

a developer bearing member for developing a latent image formed on the image bearing member, using developer; and the developing device according to claim 1.

13. An image forming apparatus comprising:

an image bearing member;

a developer bearing member for developing a latent image formed on the image bearing member, using developer;

the developing device according to claim 1; and a transfer unit configured to transfer a developer image formed on the image bearing member, onto a recording medium.

14. The developing device according to claim 1, wherein the two adjacent trap agitation blades constituting the agitation blade portion are arranged at an angle so as to make a space between the two adjacent trap agitation blades gradually wider upstream with respect to a rotation direction of the developer agitation portion.

15. The developing device according to claim 1, further comprising:

a developer bearing member for developing a latent image formed on the image bearing member.

16. A developing device comprising:

a developer storage portion configured to store developer; and a developer agitation portion configured to rotate in the developer storage portion to agitate developer;

wherein the developer agitation portion includes a plurality of trap agitation blades arranged in an axis direction of the developer agitation portion, and each of the trap agitation blades is disposed in a direction intersecting with the axis direction of the developer agitation portion, wherein a plurality of agitation blade portions, each including a set of two trap agitation blades adjacent in the axis direction of the developer agitation portion, is arranged with being shifted from one another in a circumferential direction and a longitudinal direction of the developer agitation portion, and wherein the two adjacent trap agitation blades constituting the agitation blade portion are arranged at an angle so as to make a space between the two adjacent trap agitation blades gradually wider upstream with respect to a rotation direction of the developer agitation portion, wherein the two trap agitation blades adjacent in the axis direction that constitute the agitation blade portion alternately include an agitation collection portion, a width of which becomes gradually narrower with respect to the rotation direction of the developer agitation portion.

17. A developing device comprising:

a developer storage portion configured to store developer; and a developer agitation portion configured to rotate in the developer storage portion to agitate developer;

wherein the developer agitation portion includes a plurality of trap agitation blades arranged in an axis direction of the developer agitation portion, and each of the trap agitation blades is disposed in a direction intersecting with the axis direction of the developer agitation portion, wherein a plurality of agitation blade portions, each including a set of two trap agitation blades adjacent in the axis direction of the developer agitation portion, is arranged with being shifted from one another in a circumferential direction and a longitudinal direction of the developer agitation portion, and wherein the two adjacent trap agitation blades constituting the agitation blade portion are arranged at an angle so as to make a space between the two adjacent trap agitation blades gradually wider upstream with respect to a rotation direction of the developer agitation portion, wherein the developer agitation portion includes an inverse agitation blade arranged in the axis direction of the developer agitation portion at a position between the agitation blade portions.

* * * * *